US006935810B2

(12) United States Patent
Horton, III

(10) Patent No.: US 6,935,810 B2
(45) Date of Patent: Aug. 30, 2005

(54) SEMI-SUBMERSIBLE MULTICOLUMN FLOATING OFFSHORE PLATFORM

(75) Inventor: Edward E. Horton, III, Houston, TX (US)

(73) Assignee: Deepwater Technologies, Inc., Houston, TX (US)

( * ) Notice: Subject to any disclaimer, the term of this patent is extended or adjusted under 35 U.S.C. 154(b) by 47 days.

(21) Appl. No.: 10/459,003

(22) Filed: Jun. 11, 2003

(65) Prior Publication Data

US 2004/0253060 A1 Dec. 16, 2004

(51) Int. Cl.[7] ..... B63B 35/44
(52) U.S. Cl. ..... 405/200; 405/203; 405/204; 405/205; 405/224; 114/265
(58) Field of Search ..... 405/200, 203–209, 405/223.1, 224; 114/264–266

(56) References Cited

U.S. PATENT DOCUMENTS

| | | | | |
|---|---|---|---|---|
| 3,880,102 A | | 4/1975 | Biewer | |
| 3,921,558 A | * | 11/1975 | Redshaw | 405/210 |
| 3,949,693 A | * | 4/1976 | Bauer et al. | 405/207 |
| 4,087,984 A | * | 5/1978 | Mo | 405/207 |
| 4,112,697 A | * | 9/1978 | Chow | 405/209 |
| 4,234,270 A | * | 11/1980 | Gjerde et al. | 405/202 |
| 4,498,412 A | * | 2/1985 | Liden | 114/264 |
| 4,674,919 A | * | 6/1987 | Olsen et al. | 405/226 |
| 4,850,744 A | * | 7/1989 | Petty et al. | 405/224 |
| 6,015,245 A | * | 1/2000 | Frimm et al. | 405/200 |
| 6,190,089 B1 | * | 2/2001 | Bennett et al. | 405/200 |

FOREIGN PATENT DOCUMENTS

| | | |
|---|---|---|
| DE | 27 27 082 | 12/1978 |
| GB | 1 527 759 | 10/1978 |
| GB | 2 328 408 A | 2/1999 |
| WO | WO 84/01554 | 4/1984 |
| WO | WO 01/87700 A1 | 11/2001 |
| WO | WO 02/00496 A1 | 1/2002 |

* cited by examiner

*Primary Examiner*—Frederick L. Lagman
(74) *Attorney, Agent, or Firm*—Klein, O'Neill & Singh, LLP; Howard J. Klein

(57) ABSTRACT

A semi-submersible, multicolumn, deep draft, floating offshore oil and gas drilling and production platform comprises a floating hull having an adjustably buoyant base, a plurality of columns vertically upstanding from the base, and an equipment deck that is supported atop the columns when the platform is operationally deployed. Each of the columns comprises a cellular structure that includes a plurality of elongated tubes having a variety of cross-sectional shapes extending from the base to the top of the column. Each of the tubes defines one or more closed compartments. At least one of the compartments has a buoyancy that is fixed, and at least another one of the compartments has a buoyancy that is adjustable. The buoyancy of the compartments and the base can be controllably adjusted with pressurized air to provide a safer and less costly method for deploying the platform for offshore operations.

11 Claims, 8 Drawing Sheets

SEMI-SUBMERSIBLE MULTICOLUMN FLOATING OFFSHORE PLATFORM

CROSS-REFERENCE TO RELATED APPLICATIONS (Not Applicable)

STATEMENT REGARDING FEDERALLY SPONSORED RESEARCH OR DEVELOPMENT (Not Applicable)

REFERENCE TO APPENDIX (Not Applicable)

BACKGROUND OF THE INVENTION

1. Field of the Invention

The present invention relates to floating offshore platforms in general, and in particular, to an adjustably buoyant, deep draft, semi-submersible platform for off-shore oil and gas drilling and production operations.

2. Description of Related Art

Conventional shallow draft semi-submersible offshore platforms are used primarily in offshore locations where water depth exceeds about 300 feet (91 meters). This type of semi-submersible platform comprises a hull structure that has sufficient buoyancy to support a work platform above the water surface, as well as rigid and/or flexible piping extending from the work platform to the seafloor, where one or more drilling or well sites are located.

The hull typically comprises a pair of horizontal pontoons that support a plurality of vertically upstanding columns, which in turn support the work platform above the surface of the water. The size of the pontoons and the number of columns are governed by the size and weight of the work platform and its payload being supported.

A typical semi-submersible platform has a relatively low draft, typically, about 100 ft. (30.5 m), and incorporates a conventional catenary chain-link spread-mooring arrangement for station keeping over the well sites. The motions of these types of semi-submersible platforms are relatively large, and accordingly, they require the use of "catenary" risers (either flexible or rigid) extending from the seafloor to the work platform, and the heavy wellhead equipment is typically installed on the sea-floor, rather than on the work platform. The risers present a catenary shape to absorb the large heave and horizontal motions of the conventional semi-submersible platform. Due to their large motions, conventional semi-submersible platforms cannot support high-pressure, top-tensioned risers.

Typical semi-submersible offshore platforms are described in the following references: CA 1092601, GB 2,310,634, U.S. Pat. No. 4,498,412, WO 85/03050, GB 1,527,759, WO 84/01554, GB 2,328,408, U.S. Pat. No. 6,190,089, GB 1,527,759 and WO 02/00496.

It is known that increasing the draft of a semi-submersible platform can both improve its stability and reduce its range of movement. Doing so involves locating the pontoons at a greater depth below the surface of the water, where wave excitation forces are lower. Further, the area of the pontoons can be increased, resulting in the vessel having a greater hydrodynamic mass, and hence, resistance to movement through the water. Additionally, catenary mooring can be replaced by a so-called "taut leg" mooring system, further increasing the resistance of the platform to horizontal motion. Thus, a deep draft semi-submersible platform [i.e., having a draft of at least about 150 feet (about 45 m)] can have significantly smaller vertical and horizontal motions than a conventional semi-submersible platform, thereby enabling the deep draft platform to support top-tensioned drilling and production risers without the need for disconnecting the risers during severe storms.

In both conventional and deep draft types of semi-submersible platforms, the hull is divided into several closed compartments having a buoyancy that can be adjusted for purposes of flotation and trim, and includes a pumping system for pumping ballast water into and out of the compartments. The compartments are typically defined by horizontal and/or vertical bulkheads in the pontoons and columns. Normally, the compartments of the pontoon and the lower compartments of the columns are filled with water ballast when the platform is in its operational configuration, and the upper compartments of the columns provide buoyancy for the platform. The compartmentalization of the columns with bulkheads substantially increases the manufacturing costs of the platform, especially when a high degree of compartmentalization is effected.

Additionally, the methods by which the platforms are deployed for offshore operations are not optimal. In one known method, the hull (i.e., the pontoons and columns without the work platform mounted thereon) is transported to its operation site, either by towing it at a shallow draft, or by floating it aboard a "heavy lift" vessel. When the hull is at the operation site, it is ballasted down by pumping sea water into the pontoons and columns, and the work platform is then either lifted onto the tops of the columns by heavy lift cranes carried aboard a heavy lift barge, or by floating the work platform over the top of the partially submerged hull using a deck barge. In either case, the procedure is typically effected far offshore (e.g., 100 miles, or 161 km), is performed in open seas, and is strongly dependant on weather conditions and the availability of a heavy lift barge, making it both risky and expensive.

A second known deployment method involves installing the deck on the hull at the shipyard, then transporting the fully assembled semi-submersible platform to the operation site using a heavy lift vessel. This method is also strongly dependent on the availability of a heavy lift vessel. In yet another proposed method (see, e.g., international patent application WO 01/87700), a "stabilization module" is attached to the fully assembled platform to increase its water plane area and thereby stabilize it for towing to the operation site at a shallow draft. However, the use of a stabilization module increases the cost of the towing operation, and since the platform is towed with the relatively heavy deck mounted on top of the hull, this procedure also involves some risk.

Accordingly, there is a long-felt but as yet unsatisfied need for a semi-submersible offshore platform that incorporates adjustably buoyant support columns having a relatively high degree of compartmentalization, and yet which can be manufactured more simply and cost effectively. There is also a need for a method of deploying such a platform for offshore operations that is both less expensive and less risky than current platform deployment methods.

BRIEF SUMMARY OF THE INVENTION

In accordance with the present invention, a semi-submersible, multicolumn, deep draft, floating offshore oil and gas drilling and production platform, or "Multi-Column Floater" ("MCF"), is provided that overcomes many of the above drawbacks and disadvantages of the prior art offshore platforms and their deployment methods. In a preferred embodiment thereof, the novel platform comprises a floating hull having an adjustably buoyant base, a plurality of columns vertically upstanding from the base, and an equipment deck that is supported atop the columns when the platform is operationally deployed.

Each of the columns of the hull comprises a cellular structure that includes a plurality of elongated tubes extending from the base to the top of the column. Each of the tubes defines one or more closed compartments. At least one of the compartments has a buoyancy that is fixed, and at least another one of the compartments has a buoyancy that is adjustable.

In one exemplary embodiment of the MCF, the hull comprises at least four upstanding columns connected to the base. Each of the columns comprises an elongated inner tube disposed concentrically within an elongated outer tube to define one or more closed central compartments and one or more closed annular compartments surrounding the central compartments. The central and annular compartments can be subdivided into multiple compartments by bulkheads. At least one of the central compartments has a fixed buoyancy, and at least one of the annular compartments has an adjustable buoyancy.

In another exemplary embodiment, the hull of the MCF comprises at least four upstanding columns connected to the base. Each column comprises a plurality of elongated cylindrical tubes connected together by a plurality of elongated webs to form a plurality of non-cylindrical "interstitial" tubes interspersed with the cylindrical tubes. Each of the tubes defines one or more closed compartments and, as in the embodiment above, one or more of the compartments has a fixed buoyancy and one or more of the compartments has an adjustable buoyancy.

Preferably, the fixed buoyancy compartments may be permanently sealed to contain air at atmospheric pressure, and are reinforced to resist external compressive hydrostatic pressure when submerged. The adjustable buoyancy compartments may incorporate openings at their lower ends to enable sea water ballast to flow into and out of them. In a preferred embodiment, the upper ends of these compartments are supplied with pressurized air to control precisely the level of ballast water contained therein. In an alternative embodiment, a standard ballast control system employing, e.g., a submersible pump, can be used to pump water to or from the adjustable buoyancy compartments.

A novel method for deploying the MCF platform for offshore operations eliminates the need for a heavy lift vessel or a float-over-deck operation in open seas. The novel deployment method comprises towing the hull (i.e., the base and attached upstanding columns) in a shallow draft configuration from its manufacturing site to an intermediate site in deeper water which is relatively shielded from wind and high waves. At the intermediate site, the hull is ballasted down with sea water to a deep draft configuration such that the tops of the columns extend just above the surface of the water, and a deck barge supporting an associated equipment deck is floated between the columns such that the deck is disposed over the tops of the columns. The columns are then de-ballasted so that the tops of the columns engage and lift the deck off the barge, and the hull is placed in an intermediate draft configuration. Alternatively, or simultaneously, the deck barge can be ballasted down to effect the deck-and-column engagement. The assembled MCF, with the equipment deck secured thereon, is then towed to the operation site in the intermediate draft configuration, where it is ballasted down to its operational, deep draft configuration, and anchored at the operation site using either a taut leg or conventional catenary mooring system.

A better understanding of the above and many other features and advantages of the present invention may be obtained from a consideration of the detailed description thereof found below, particularly if such consideration is made in conjunction with the several views of the appended drawings.

DETAILED DESCRIPTION OF THE INVENTION

Figure 1:
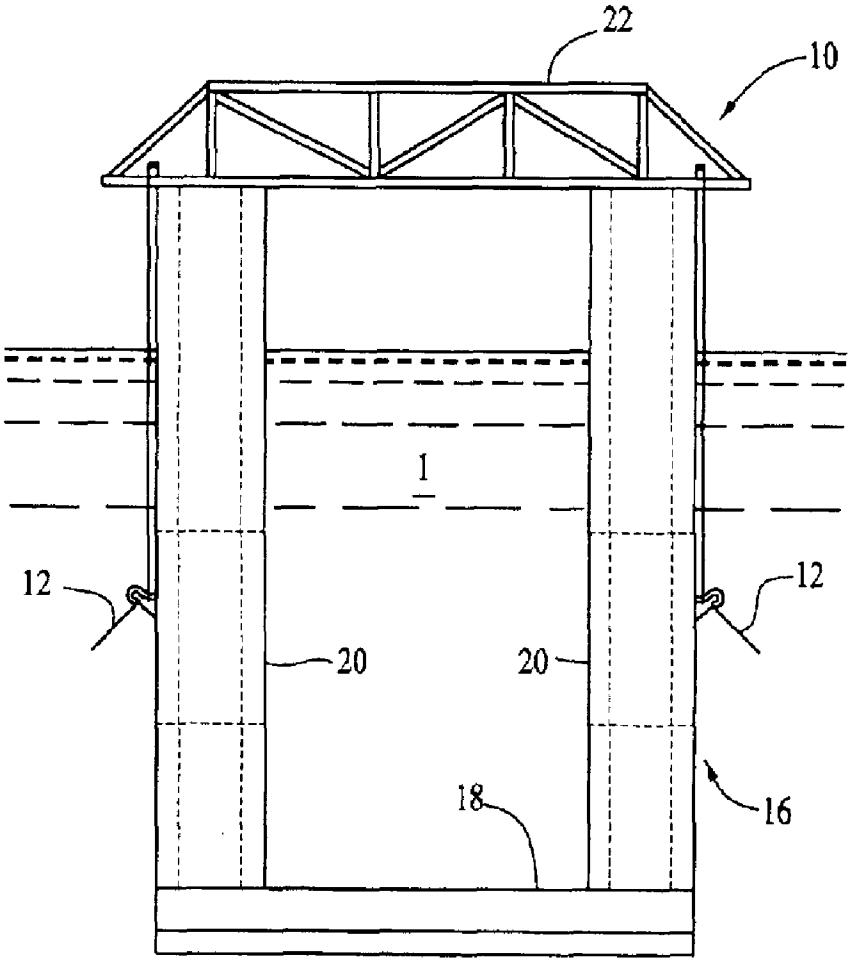
FIG. 1 is an elevation view of an exemplary embodiment of a semi-submersible multicolumn floating offshore platform, or "Multi-Column Floater" ("MCF"), in accordance with the present invention, shown deployed in a body of water in a deep draft operational configuration and anchored over an operations site with a taut leg mooring system.
Figure 5:
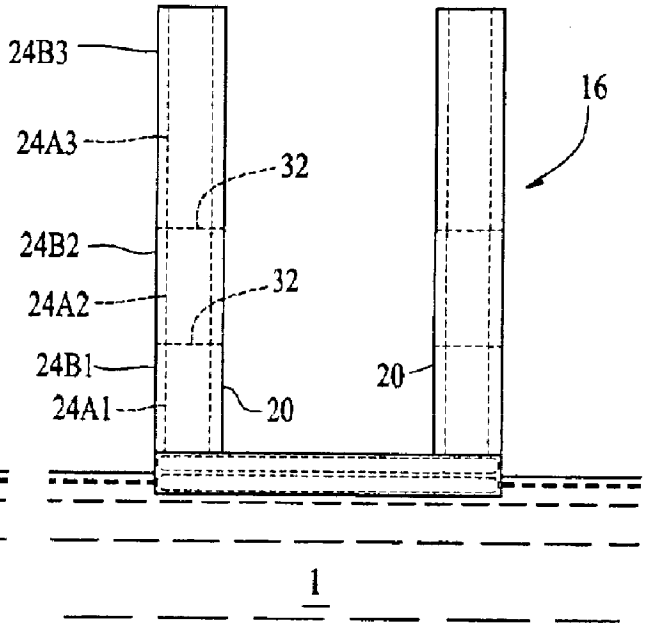
FIG. 5 is an elevation view of the hull of the MCF of FIG. 3 or 4 after all of the upstanding, adjustably buoyant support columns have been attached to the base thereof.

FIG. 1 is an elevation view of an exemplary embodiment of a semi-submersible multicolumn floating offshore platform 10, or "Multi-Column Floater" ("MCF"), in accordance with the present invention, shown deployed in a body of water 1 in a deep draft operational configuration and anchored over an operation site with a taut leg mooring system 12. The MCF is shown deployed in a similar configuration in the elevation view of FIG. 12, anchored at an operation site by a conventional catenary mooring system 14.

As shown in the figures, the exemplary MCF 10 comprises a floating hull 16 having an adjustably buoyant base 18, a plurality of adjustably buoyant columns 20 vertically upstanding from the base 18, and a work platform, or equipment deck 22, that is supported atop the columns 20 when the platform is operationally deployed. Each of the columns 20 of the hull 16 comprises a cellular structure that includes a plurality of elongated tubes 24 (see FIGS. 13–16) extending from the base 18 to the top of the columns 20. Each of the tubes 24 defines one or more closed compartments 26. The lowermost of the compartments 26 has a fixed or solid ballast, and the remaining compartments 26 above the one with a fixed ballast have buoyancies that are adjustable, as described in more detail below.

Figure 2:
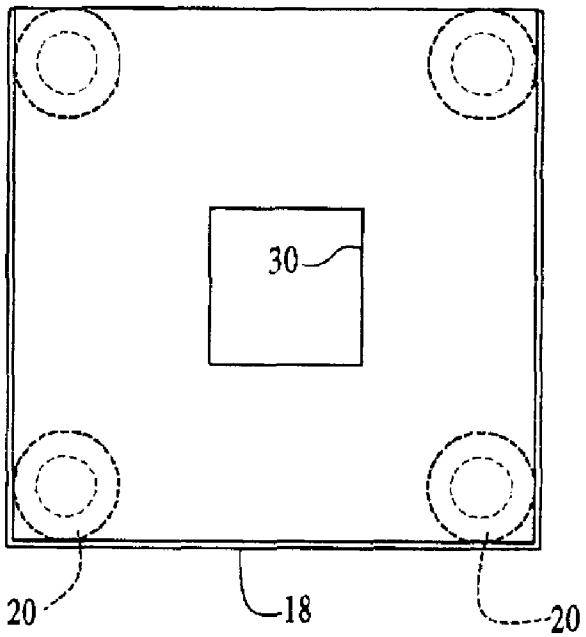
FIG. 2 is a bottom plan view of the MCF of FIG. 1.

The base 18 of the hull 16 comprises a plurality of ballast tanks 28 (see FIGS. 13, 15) that can be selectably filled with ballast water to adjust the buoyancy of the base, and may also include a central opening 30 (see FIG. 2) through which risers (not illustrated) may pass up to the equipment deck 22. The equipment deck mounts the various equipment (not illustrated) typically used in oil and gas drilling or production operations, such as a derrick, draw works, pumps, scrubbers, precipitators and the like.

Figure 14:
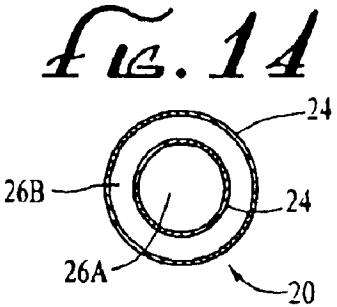
FIG. 14 is a cross-sectional view of the first embodiment of the support column of FIG. 13, as revealed by the section taken therein along the lines 14—14.
Figure 13:
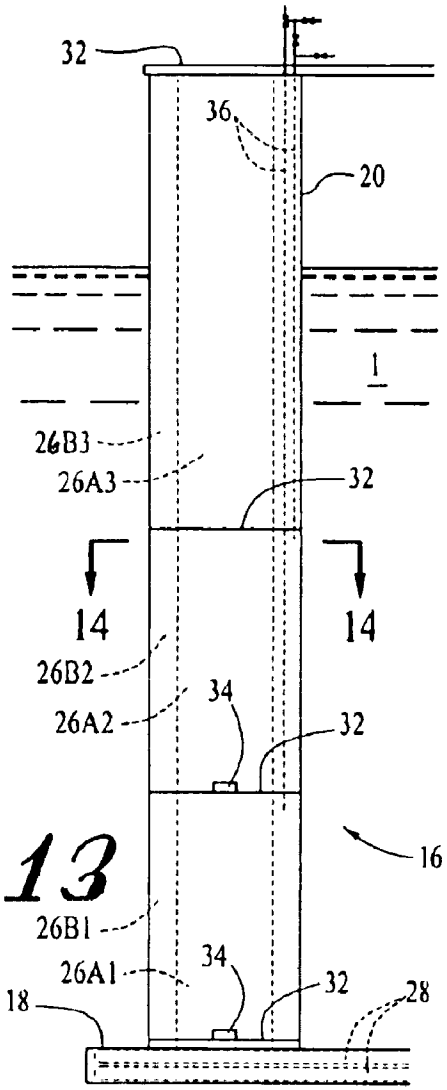
FIG. 13 is a partial elevation view of the hull of the MCF showing a first exemplary embodiment of an upstanding, adjustably buoyant support column in accordance with the present invention.

The MCF 10 includes at least three, and preferably at least four, columns 20, with four being shown in the exemplary embodiment shown in the drawings. Each of the columns 20 comprises a pair of concentric cylindrical tubes 24, i.e., a smaller, substantially cylindrical inner tube arranged coaxially, or concentrically, within a larger, substantially cylindrical outer tube, as illustrated in FIGS. 13 and 14. In an exemplary embodiment of these columns, the inner tube has a diameter of about 25 ft. (7.6 m), and the outer tube has a diameter of about 40 ft. (12.2 m), and is fabricated of rolled and seam-welded steel plate having a thickness of from between about 0.625–0.785 in. (1.59–2.00 cm). This concentric arrangement defines two elongated vertical compartments in the column, viz., a cylindrical central compartment 26A and an annular outer compartment 26B, which may be closed off with bulkheads 32 at their respective upper and lower ends. One of these compartments, preferably the central cylindrical compartment, may be used for fixed buoyancy, and the other, viz., the annular outer compartment, may be used for adjustable buoyancy, as described below.

Each of the two vertical compartments 26A and 26B in the column 20 may be subdivided into smaller compartments by the provision of horizontal decks, or bulkheads 32, for safety purposes. For example, as illustrated in FIG. 13, the two coaxial compartments may be subdivided by two horizontal bulkheads respectively defining three cylindrical central compartments 26A1–26A3 and three annular compartments 26B1–26B3. This arrangement enables a high degree of compartmentalization to be achieved in the columns at a relatively low cost.

The two lower annular compartments 26B1 and 26B2 may used for adjustable buoyancy and include openings 34 to the sea at their respective lower ends to enable sea water to enter and exit them. To control the water level in these two compartments, pressurized air is controllably supplied to each of the compartments by means of inexpensive piping 36 extending into the respective upper ends of the compartments. Varying the air pressure within the compartments results in a corresponding variation in the level of ballast water in the compartments. The upper annular compartment 26B3 and the three central cylindrical compartments 26A1–26A3 in the column may be used for fixed buoyancy, by simply sealing them with air at atmospheric pressure, to provide buoyancy to the hull 16 and support the equipment deck 22 and riser system.

Figure 16:
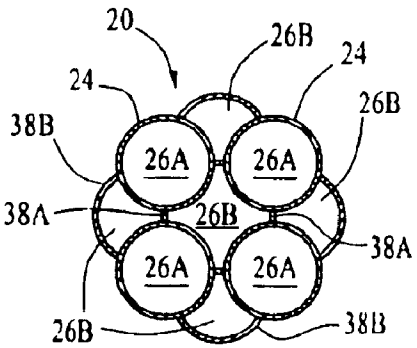
FIG. 16 is a cross-sectional view of the second embodiment of the support column of FIG. 15, as revealed by the section taken therein along the lines 16—16.
Figure 15:
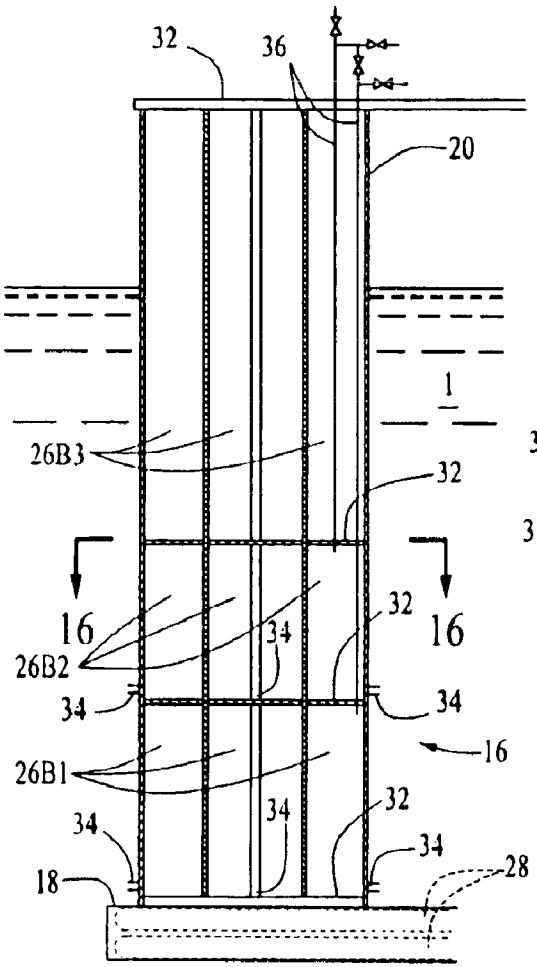
FIG. 15 is a partial cross-sectional elevation view of the hull of the MCF showing a second exemplary embodiment of an upstanding, adjustably buoyant support column in accordance with the present invention.

In another exemplary preferred embodiment of the MCF 10, each of the columns 20 comprises a group of tubular cells, i.e., a plurality of parallel and adjacent cylindrical tubes 24 connected to each other laterally with a plurality of elongated, planar and arcuate webs 38A and 38B, as illustrated in FIGS. 15 and 16. Each of the cylindrical tubes defines a cylindrical vertical compartment 26A, and the elongated webs in association with the cylindrical tubes define non-cylindrical "interstitial" vertical compartments 26B. As in the first embodiment above, horizontal bulkheads 32 can be used to increase the number of buoyancy compartments in the column, and as above, the compartments may be used for either fixed or adjustable buoyancy.

In the second embodiment of the columns 20 illustrated in FIGS. 15 and 16, the cylindrical compartments 26A1–26A3 are used primarily for fixed buoyancy, and accordingly, are sealed with air at atmospheric pressure. The interstitial compartments 26B1–26B3 are used primarily for adjustable buoyancy, and as in the first embodiment above, are opened to the sea at their lower ends such that pressurized air may be used to admit or expel ballast water to or from them in the following manner.

The cylindrical fixed buoyancy compartments 26A1–26A3 are permanently scaled and contain air at atmospheric pressure. Accordingly, they must be capable of resisting large external compressive hydrostatic pressures when they are submerged, and their cylindrical shape is optimal for this purpose. The adjustable buoyancy compartments 26B1–26B2 incorporate openings at their lower ends to enable water to flow into and out of them. In a preferred embodiment, pressurized air is supplied at the upper ends of these compartments with low cost piping 36 to control the level of water ballast contained therein. By varying the air pressure within the compartments, the level of water ballast contained in the compartments, and hence, their buoyancy, can be precisely controlled. Further, since the internal pneumatic and external hydraulic pressures acting on the adjustable ballast compartments are in equilibrium, the compartments need not be reinforced to resist large hydrostatic pressures, which simplifies their design and reduces the amount of steel used in their fabrication, and hence, the overall weight and cost of the hull 16.

This arrangement is particularly advantageous from a structural standpoint because, unlike the fixed buoyancy cylindrical compartments 26A1–26A3, which are optimally shaped to withstand large hydrostatic compressive forces, the interstitial vertical compartments 26B1–26B3 have compound shapes that are less able to withstand such pressures without reinforcement. However, by utilizing them for variable buoyancy in the manner described above, they need only be capable of withstanding the small pressure differentials between the external sea water and the internal air when ballast water is admitted to or expelled from them, and are otherwise in pressure and stress equilibrium, regardless of their depth and ballast water content.

Of course, in an alternative embodiment, a standard ballast control system employing, e.g., a submersible pump, can be used to pump water to or from the adjustable buoyancy chambers 26B1–26B3. However, in such an embodiment, the adjustable buoyancy compartments must be sufficiently reinforced to withstand the relatively large external compressive hydrostatic pressures found at depth.

As will be appreciated by those of skill in the art, the elongated tubes 24 of either embodiment of the column 20 of the hull 16 described above define cellular structures that provide the column with a high degree of compartmentalization at a relatively low cost. Each tube defines a vertical compartment 26A or 26B that can be used for either fixed or adjustable buoyancy. If desired, these vertical compartments can be easily subdivided by the provision of horizontal bulkheads 32 within them. However, compared to prior art platforms, only a few bulkheads are required to achieve the same degree of compartmentalization. Additionally, the foregoing compartmentalization scheme contemplates only two types of compartments, viz., fixed buoyancy and adjustable buoyancy compartments, and can be applied to either concentric cylindrical tubular columns or to grouped cellular columns, as described above. The fixed buoyancy compartments are normally sealed and are opened only for periodic inspections or in the event of a leak. The adjustable buoyancy compartments employ active water ballasting, and accordingly, incorporate means for introducing and removing ballast water from the compartments. As a result of this compartmentalization scheme, the fixed buoyancy compartments require only minimal hull penetrations, e.g., for piping 36, and further, eliminate the need for expensive interior coatings for corrosion protection. The adjustable buoyancy compartments require only simple, inexpensive air or ballast water piping extending down from the top ends of the columns to the respective compartments, to inject or vent pressurized air to and from these compartments and thereby control their respective sea water ballast contents precisely.

Figure 18:
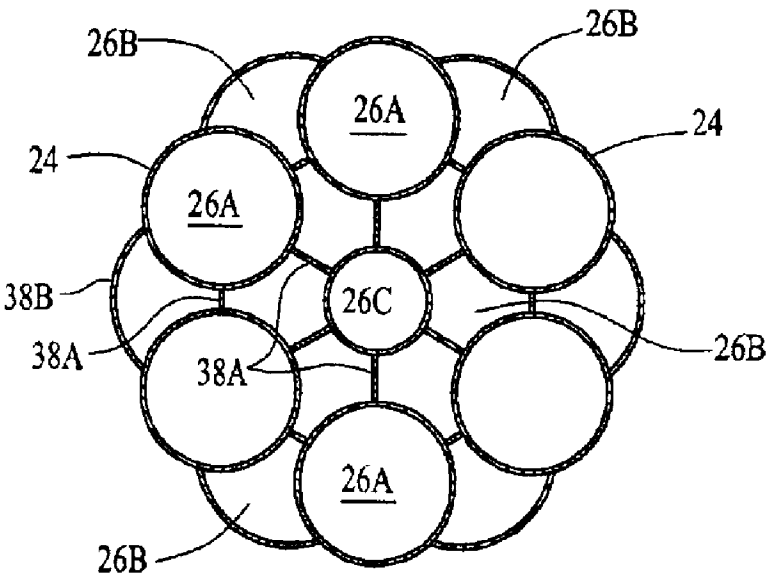
Figure 17:
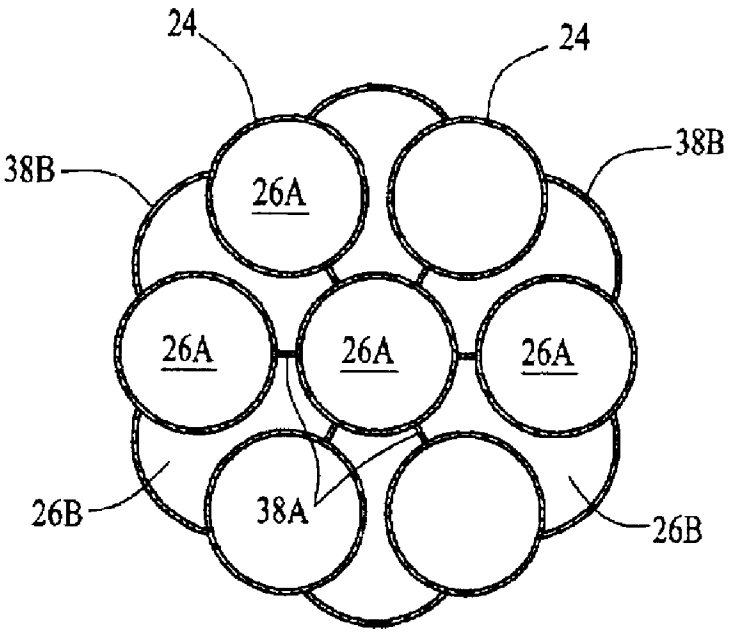
FIG. 17 is a cross-sectional view of a third embodiment of an adjustably buoyant support column in accordance with the present invention; and, FIG. 18 is a cross-sectional view of a fourth embodiment of an adjustably buoyant support column in accordance with the present invention.

Preferably, each of the compartments 26A and 26B of the columns 20 is provided with an access hatch in the associated upper bulkhead to enable inspection of its interior. Alternatively, as illustrated in the cross-sectional view of FIG. 18, each column may comprise a central cylindrical tubular access shaft 26C dedicated to inspection purposes. In such an embodiment, lateral hatches (not illustrated) located at each deck level can provide access to each of the compartments of the column for inspection purposes. FIGS. 17 and 18 both show cross-sectional views of alternative embodiments of grouped cellular columns.

Figure 3:
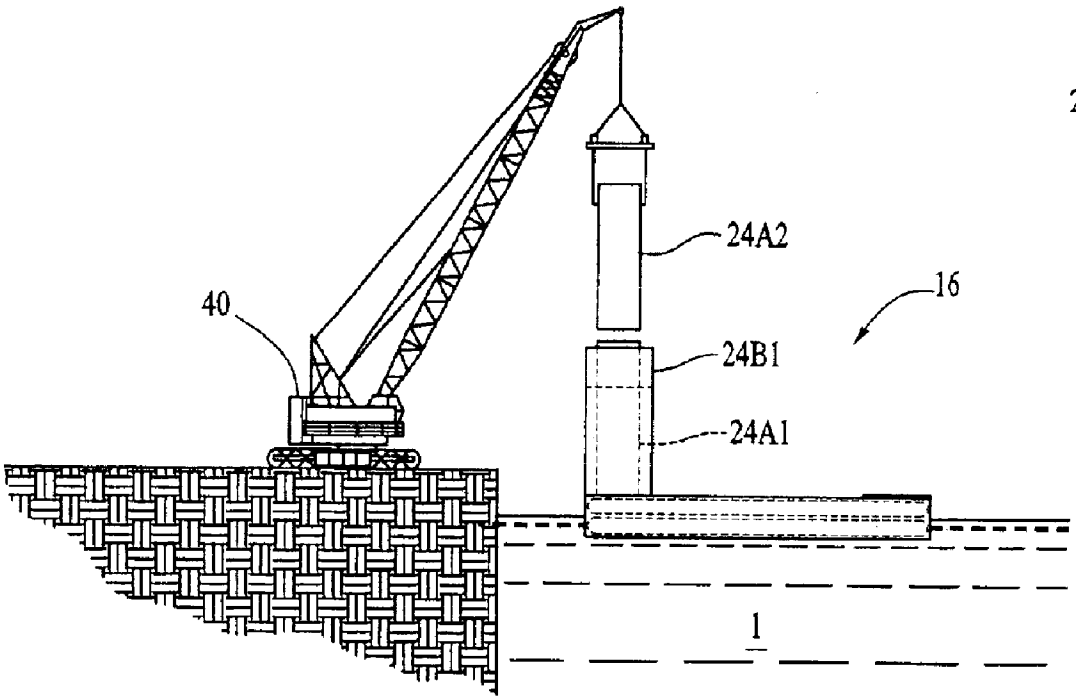
FIG. 3 is an elevation view of the hull of the MCF of FIG. 1 showing one method of assembling and attaching an upstanding, adjustably buoyant support column of the hull to the base thereof.

FIG. 3 illustrates one method for assembling an MCF hull 16 having concentric columns 20, as described in the first embodiment above. The base 18 is provided in a shallow draft configuration at the dock yard, and the columns are welded to the base in levels. First, a cylindrical inner tube 24A1 is welded to the base, then a cylindrical outer tube 24B1 is slid down concentrically over the inner tube and welded to the base. A common horizontal bulkhead 32 may be welded on the upper ends of both tubes. These steps are then repeated until the desired height of the column is achieved.

Figure 4:
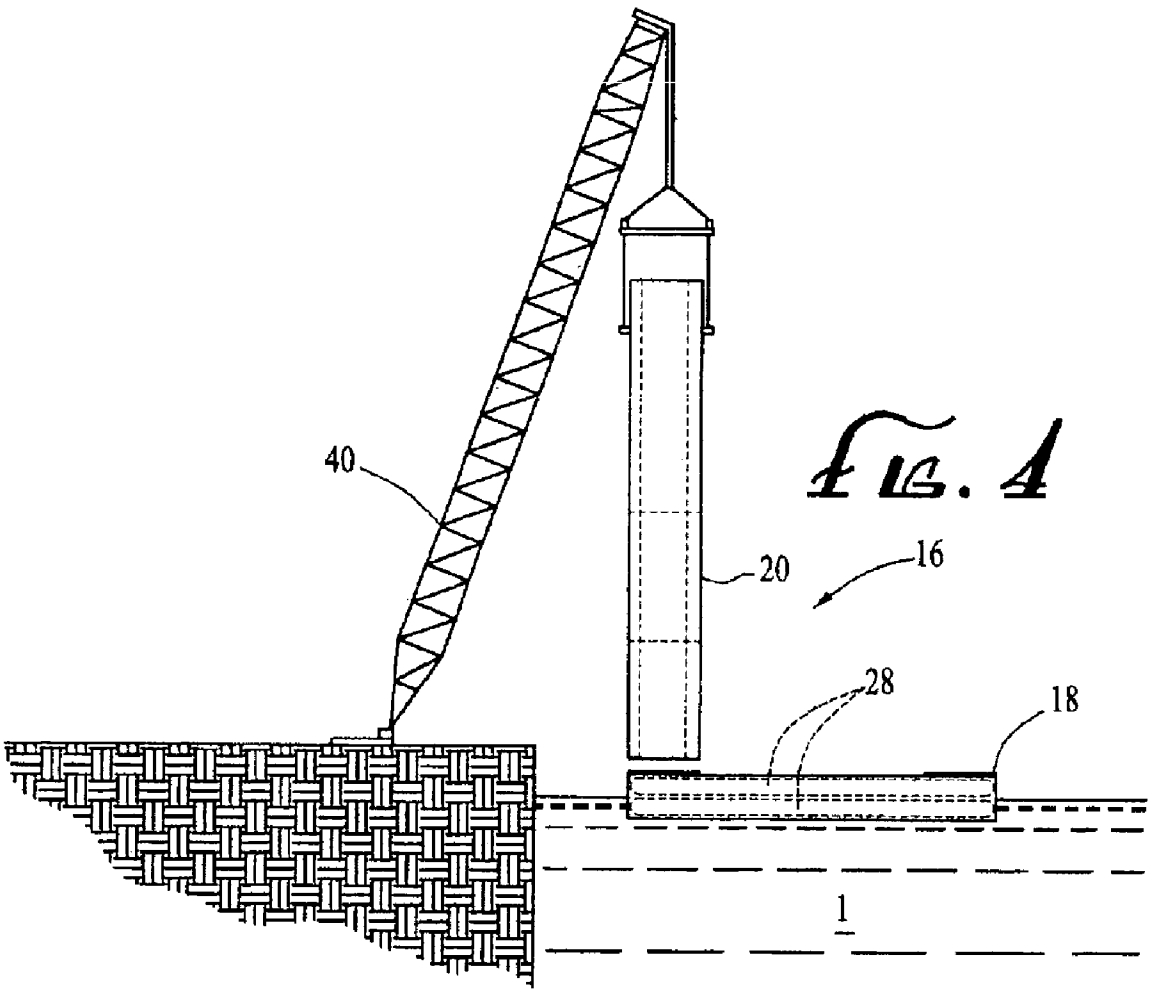
FIG. 4 is an elevation view similar to FIG. 3 showing an alternative method of attaching a fully assembled upstanding column of the hull to the base thereof.

FIG. 4 illustrates an another method for assembling an MCF hull 16 which may be used with either concentric columns 20 or group tubular-celled columns in which the entire columns are constructed in parallel with the base 18 at the yard, and the finished columns then lifted onto the base with a heavy lift crane 40 and welded thereon.

The characteristics of the MCF 10 of the present invention, i.e., its draft, column 20 number and spacing, size, weight, and base 18 configuration provide it with excellent motion characteristics. The draft and the water plane area of the platform are such that the natural periods in heave, roll and pitch are far greater than those of a "100 year storm." For example, for typical Gulf of Mexico ("GOM") operations, the peak period of a 100 year storm is about 16 seconds, while one embodiment of the novel deep draft MCF has a natural period in heave of about 20 seconds and a natural period in roll and pitch of about 50 seconds. This results in the MCF having correspondingly small motions, viz., a heave of less than about 11 feet peak-to-peak and a pitch of less than about 8°. These motions enable the MCF to employ vertical top-tensioned risers and surface-mounted wellhead equipment, and also minimizes fatigue stresses on steel catenary risers.

Figure 6:
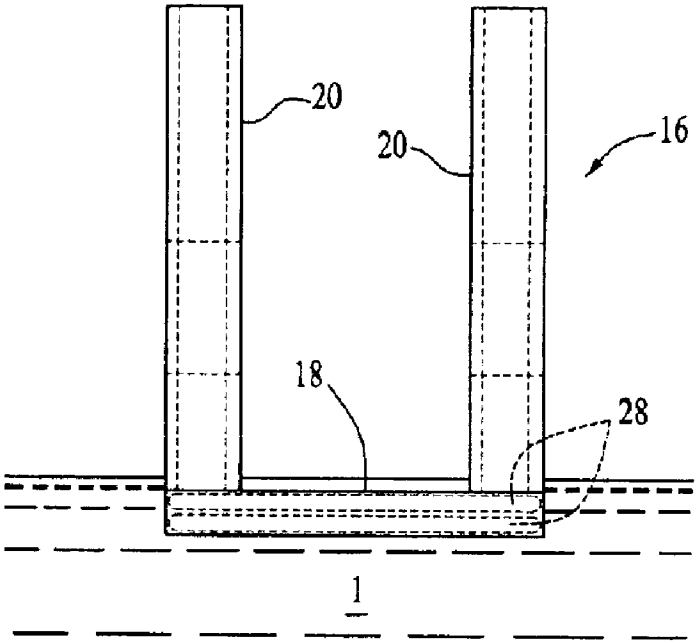
FIG. 6 is an elevation view of the hull of the MCF showing the hull ballasted down to a shallow draft configuration in which the base of the hull is submerged just below the surface of the water.

Another advantage provided by the MCF 10 of the present invention is the novel method by which it may be deployed for offshore operations. This deployment method eliminates the need for a heavy lift vessel or a risky float-over-deck operation in open seas. The MCF deployment method comprises towing the hull 16 of the MCF (i.e., the base 18 and the attached upstanding columns 20) in a shallow draft configuration, as illustrated in FIG. 6, from its manufacturing site to an intermediate site in deeper water that is relatively shielded from wind and waves.

Figure 7:
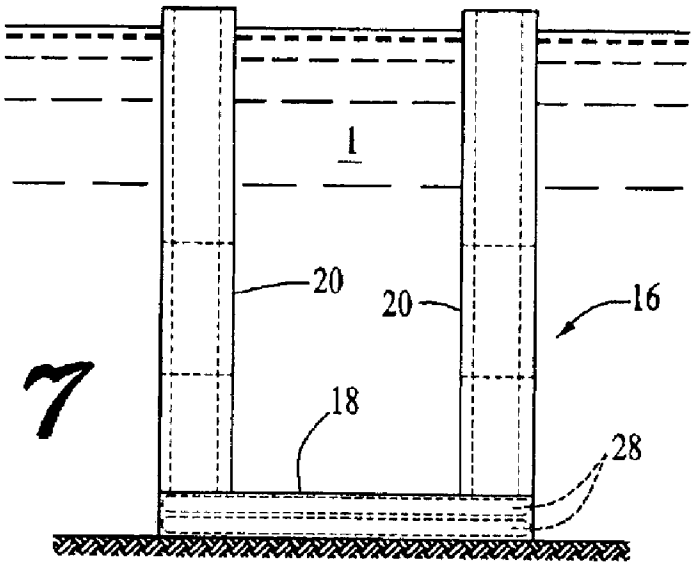
FIG. 7 is an elevation view of the hull of the MCF showing the hull ballasted down to a deep draft configuration in which the base of the hull is resting on the floor of the body of water.
Figure 10:
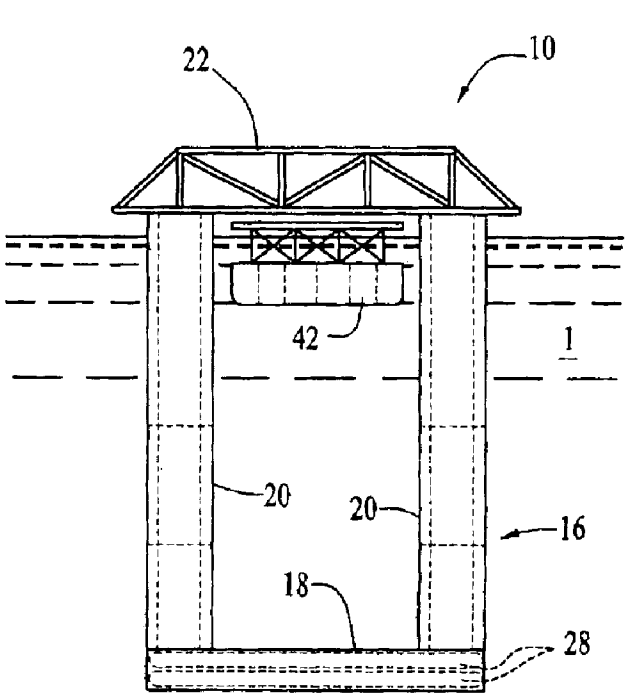
FIG. 10 is an elevation view similar to FIG. 8 in which the deck barge is shown ballasted down such that the equipment deck is lifted off the barge and supported on the tops of the columns.
Figure 8:
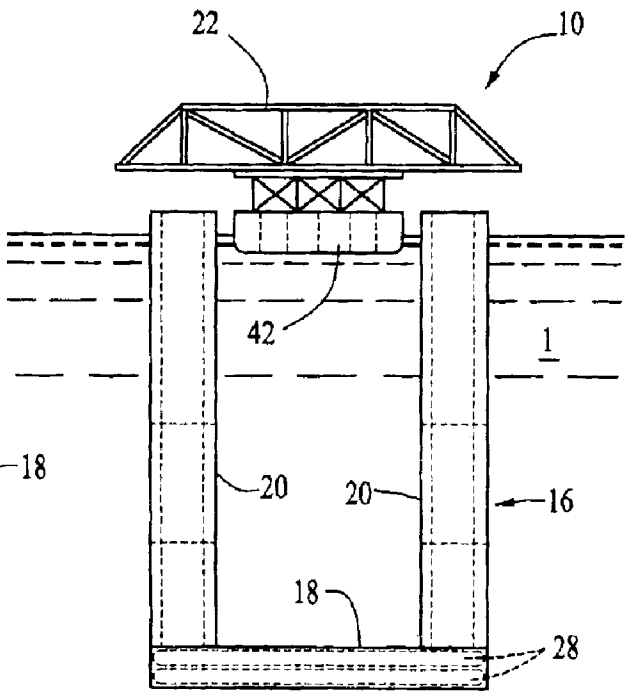
FIG. 8 is an elevation view of the hull of the MCF showing the hull in a deep draft configuration in which the top ends of the support columns thereof extend just above the surface of the water, and in which a deck barge bearing an equipment deck is shown floating between the columns such that the equipment deck is disposed above the top ends of the columns.
Figure 9:
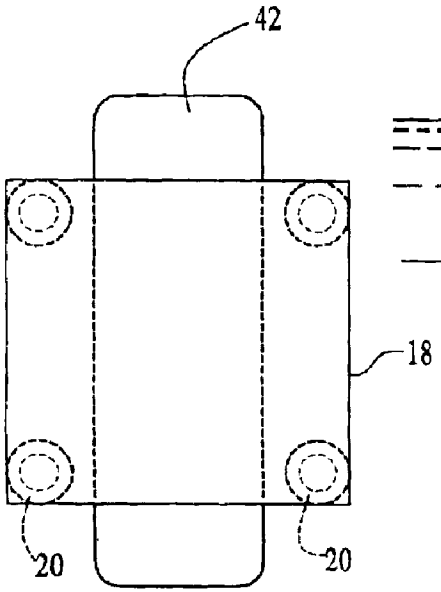
FIG. 9 is a bottom plan view of the MCF and deck barge of FIG. 8.

At the intermediate site, the hull 16 is ballasted down with sea water to a deep draft configuration such that the tops of the columns extend just above the surface of the water, as illustrated in FIG. 7. A deck barge 42 supporting an associated equipment deck 22 is then floated between the columns 20 such that the deck is disposed over the tops of the columns, as illustrated in FIGS. 8 and 9. The columns are then de-ballasted so that the tops of the columns engage and lift the deck off the barge, as illustrated in FIG. 10. Alternatively, the barge may be ballasted down to transfer the weight of the deck from the barge to the columns, or the barge may be ballasted down simultaneously with the de-ballasting of the columns to accelerate the procedure.

Figure 12:
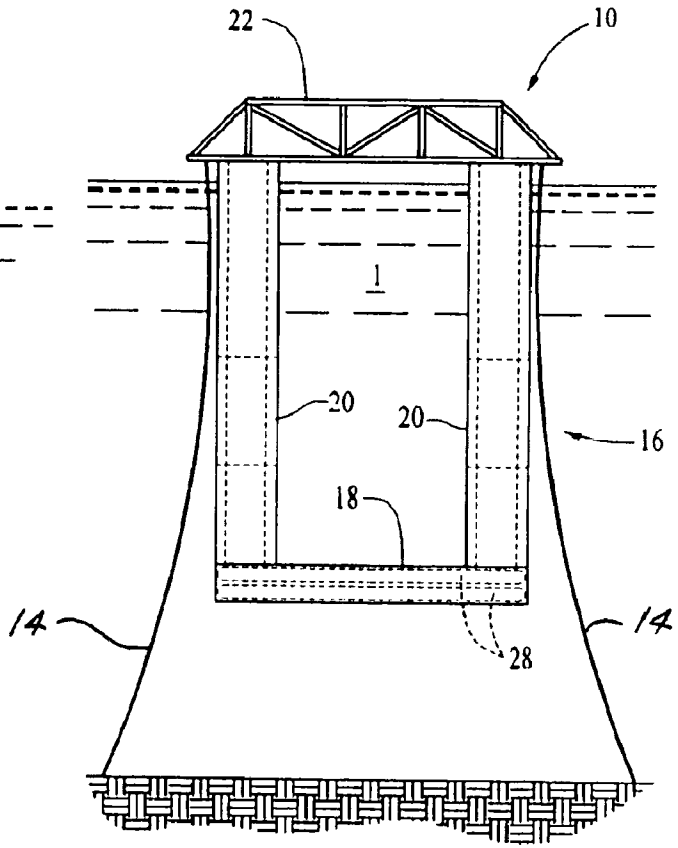
FIG. 12 is an elevation view of the MCF shown ballasted down to its operational, deep draft configuration, and anchored at the operational site using a catenary mooring system.
Figure 11:
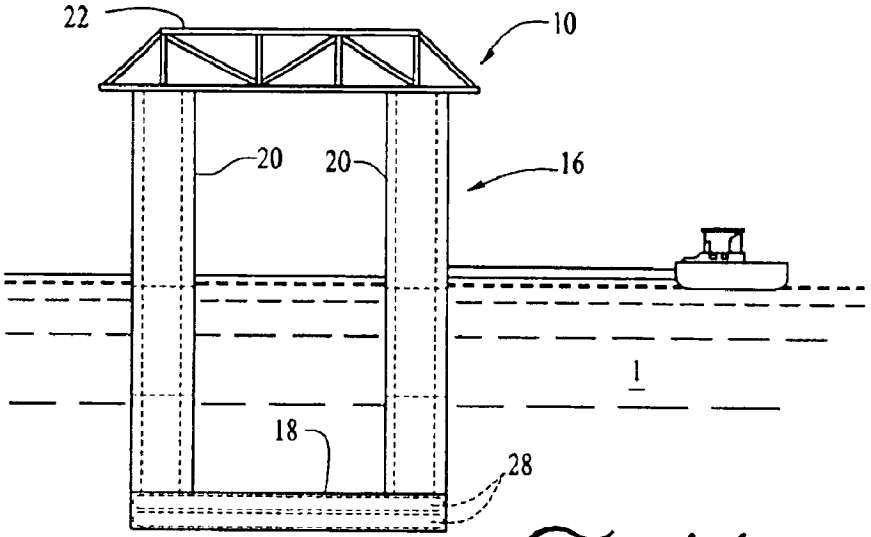
FIG. 11 is an elevation view of the MCF being towed in the water after the equipment deck has been mounted on the columns and the hull has been de-ballasted to an intermediate draft configuration.

After the equipment deck 22 is transferred to the hull 18 and secured thereon, the hull is de-ballasted to an intermediate draft configuration, and the assembled MCF 10, with the equipment deck secured thereon, is then towed to the operation site in the intermediate draft configuration, as illustrated in FIG. 11. At the operations site, the hull is ballasted down to its operational, deep draft configuration, and is then anchored at the operation site using either a taut leg mooring system 12, as illustrated in FIG. 1, or a conventional catenary mooring system 14, as illustrated in FIG. 12.

During the hull 16 ballasting steps, the ballast tanks 28 of the base 18 must be ballasted with sea water. Since these tanks initially contain air at atmospheric pressure, they are subjected to increasingly greater differential hydrostatic pressures as the base submerges. The procedure described below enables this pressure differential to be substantially reduced, and also enables the submergence of the base to be controlled more precisely. Thus, the step of ballasting the hull 16 down such that the top of the columns 20 extend just above surface of the water preferably includes the following procedures.

A first set of the tanks 28 in the base 18 is selected to be completely flooded with sea water ballast, and a second set of the tanks is selected to be only partially filled with sea water. The air in the second set of tanks is pressurized to a pressure that is about the same as the hydrostatic pressure of the sea water at a depth equal to the height of the columns. The first set of tanks is opened to sea water such that all the air in the tanks is completely displaced with sea water. The bottoms of the second set of tanks are also opened to sea water, and the tops of the second set of tanks are then vented to the atmosphere to enable sea water to enter the second set of tanks in a controlled manner. When the base reaches its maximum depth, the internal and external pressures on the second set of tanks are then about equalized.

To increase the speed of de-ballasting the columns 20, some of the lower adjustable buoyancy compartments 26B1 may contain pressurized air at ambient sea pressure. During the de-ballasting operation, the pressurized air in these lower compartments may be selectably connected to adjustable buoyancy compartments 26B2 containing ballast water that are located higher in the structure, and the pressurized air in the lower compartments may thus be used advantageously to force water out of the higher compartments, since the pressure of the air in the higher compartments is lower than that of the air in the lower compartments.

By now, it will be apparent to those of skill in the art that many variations, modifications and substitutions are possible in terms of the materials and methods of the MCF 10 of the present invention without departing from its spirit and scope. For example, the MCF can comprise more columns 20 than the four described and illustrated herein. Further, the tubes 24A and 24B of the columns may take shapes other than cylindrical, e.g., elliptical or polygonal. Accordingly, the scope of the present invention should not be limited by the particular embodiments described and illustrated herein, as these are merely exemplary in nature. Rather, the scope of the present invention should be commensurate with that of the claims appended hereafter and their functional equivalents.

What is claimed is:

1. A hull for an offshore semi-submersible platform, comprising:

a base having an adjustable buoyancy; and, a plurality of upstanding columns connected to the base, each column comprising a plurality of elongated, closely-spaced cylindrical tubes connected together by a plurality of vertically elongated webs to form a plurality of non-cylindrical interstitial tubes interspersed with the cylindrical tubes, each of the cylindrical tubes defining a plurality of vertically-arranged, substantially cylindrical compartments, and each of the interstitial tubes defining a plurality of vertically-arranged, non-cylindrical interstitial compartments;

wherein at least one of the cylindrical compartments has a buoyancy that is fixed and at least one of the interstitial compartments has a buoyancy that is adjustable.

2. The hull of claim 1, wherein at least one of the webs is substantially planar.

3. The hull of claim 1, wherein at least one of the webs is arcuate.

4. The hull of claim 1, further comprising a horizontal bulkhead subdividing the cylindrical and interstitial tubes into cylindrical and interstitial compartments, respectively.

5. The hull of claim 1, wherein the at least one adjustably buoyant compartment comprises:

an opening to ambient sea water at a lower end of the compartment;

means for introducing pressurized air into an upper end of the compartment; and, means for venting the upper end of the compartment to atmospheric pressure.

6. The hull of claim 1, wherein at least one of the cylindrical tubes comprises a shaft providing access to at least some of the compartments.

7. A method for deploying a floating deep-draft semi-submersible offshore platform, comprising:

providing a hull having an adjustably buoyant base and a plurality of upstanding, adjustably buoyant columns at an inshore water site;

de-ballasting the hull to a shallow draft configuration;

towing the hull in the shallow draft configuration to an intermediate site having deeper water that is shielded from wind and waves;

ballasting the hull such that top ends of the columns extend slightly above the surface of the water;

providing a deck supported by a buoyant deck barge;

transferring the weight of the deck from the barge to the top ends of the columns;

securing the deck to the columns to form the semi-submersible platform;

de-ballasting the hull to an intermediate draft configuration;

towing the platform to an operation site in the intermediate draft configuration;

ballasting the hull to an operational draft configuration; and, anchoring the platform at the operational site with a mooring system.

8. The method of claim 7, wherein transferring the weight of the deck from the barge to the top ends of the columns comprises:

floating the barge between the columns such that the deck is disposed over the top ends of the columns; and, de-ballasting the columns such that the deck is lifted off the barge by the columns.

9. The method of claim 7, wherein transferring the weight of the deck from the barge to the top ends of the columns comprises:

floating the barge between the columns such that the deck is disposed over the top ends of the columns; and, ballasting the barge down such that the deck is lifted off the barge by the columns.

10. The method of claim 7, wherein ballasting the hull comprises:

selecting a first set of ballast tanks in the base of the hull to be completely flooded with sea water ballast;

selecting a second set of ballast tanks in the base to be partially filled with sea water ballast;

pressurizing air in the second set of tanks to a pressure that is about the same as the hydrostatic pressure of the sea water at a depth equal to the height of the columns of the hull;

opening the first set of tanks to ambient sea water such that all air in the tanks is completely displaced with sea water;

opening the bottoms of the second set of tanks to ambient sea water; and, venting the top of the second set of tanks to the atmosphere in a controlled manner.

11. The method of claim 7, wherein the columns comprise adjustably buoyant compartments, and wherein de-ballasting the hull comprises connecting pressurized air in lower ones of the compartments to higher ones of the compartments.

* * * * *

US006935810C1

(12) EX PARTE REEXAMINATION CERTIFICATE (6655th)

United States Patent

Horton, III

(10) Number: US 6,935,810 C1

(45) Certificate Issued: Feb. 10, 2009

(54) SEMI-SUBMERSIBLE MULTICOLUMN FLOATING OFFSHORE PLATFORM

(75) Inventor: Edward E. Horton, III, Houston, TX (US)

(73) Assignee: AGR Deepwater Development Systems, Inc., Houston, TX (US)

Reexamination Request:
No. 90/008,454, Feb. 21, 2007

Reexamination Certificate for:

| | |
|---|---|
| Patent No.: | **6,935,810** |
| Issued: | **Aug. 30, 2005** |
| Appl. No.: | **10/459,003** |
| Filed: | **Jun. 11, 2003** |

(51) Int. Cl.

| | |
|---|---|
| ***E02B 17/08*** | (2006.01) |
| ***B63B 35/44*** | (2006.01) |

(52) U.S. Cl. ..... 405/200; 405/203; 405/204; 405/205; 405/224; 114/265

(58) Field of Classification Search ..... None

See application file for complete search history.

(56) References Cited

U.S. PATENT DOCUMENTS

| | | | |
|---|---|---|---|
| 3,654,886 | A | 4/1972 | Silverman |
| 4,648,750 | A | 3/1987 | Horton |
| 6,213,045 | B1 | 4/2001 | Gaber |

FOREIGN PATENT DOCUMENTS

| | | | |
|---|---|---|---|
| GB | 2170248 | A | 7/1986 |

*Primary Examiner*—Aaron J. Lewis

(57) ABSTRACT

A semi-submersible, multicolumn, deep draft, floating offshore oil and gas drilling and production platform comprises a floating hull having an adjustably buoyant base, a plurality of columns vertically upstanding from the base, and an equipment deck that is supported atop the columns when the platform is operationally deployed. Each of the columns comprises a cellular structure that includes a plurality of elongated tubes having a variety of cross-sectional shapes extending from the base to the top of the column. Each of the tubes defines one or more closed compartments. At least one of the compartments has a buoyancy that is fixed, and at least another one of the compartments has a buoyancy that is adjustable. The buoyancy of the compartments and the base can be controllably adjusted with pressurized air to provide a safer and less costly method for deploying the platform for offshore operations.

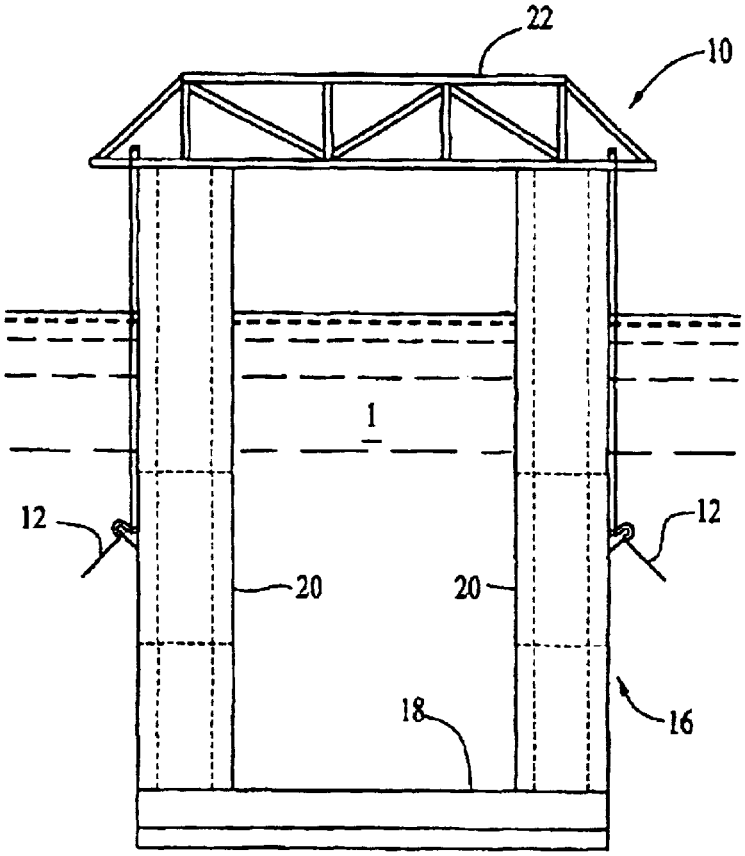

EX PARTE REEXAMINATION CERTIFICATE ISSUED UNDER 35 U.S.C. 307

NO AMENDMENTS HAVE BEEN MADE TO THE PATENT

AS A RESULT OF REEXAMINATION, IT HAS BEEN DETERMINED THAT:

The patentability of claims 1–11 is confirmed.

* * * * *